US010874007B2

(12) United States Patent
Wölfing et al.

(10) Patent No.: US 10,874,007 B2
(45) Date of Patent: Dec. 22, 2020

(54) LIGHTING DEVICE WITH CONSISTENT LIGHTING PROPERTIES

(71) Applicant: SCHOTT AG, Mainz (DE)

(72) Inventors: Bernd Wölfing, Mainz (DE); Oliver Keiper, Hünstetten (DE); Sandra Mattheis, Eltville (DE); Andreas Schneider, Neu-Bamberg (DE); Marc Timon Sprzagala, Mainz (DE); Andreas Dietrich, Guldental (DE); Thomas Reichert, Wackernheim (DE); Sebastian Biel, Hemsbach (DE)

(73) Assignee: SCHOTT AG, Mainz (DE)

( * ) Notice: Subject to any disclaimer, the term of this patent is extended or adjusted under 35 U.S.C. 154(b) by 45 days.

(21) Appl. No.: 16/188,931

(22) Filed: Nov. 13, 2018

(65) Prior Publication Data

US 2019/0082516 A1 Mar. 14, 2019

Related U.S. Application Data

(63) Continuation of application No. PCT/EP2017/060944, filed on May 8, 2017.

(30) Foreign Application Priority Data

May 11, 2016 (DE) ..... 10 2016 108 754

(51) Int. Cl.
*H05B 45/22* (2020.01)
*H05B 45/20* (2020.01)
(Continued)

(52) U.S. Cl.
CPC ..... *H05B 45/22* (2020.01); *H05B 45/20* (2020.01); *H05B 47/175* (2020.01); *H05B 47/11* (2020.01)

(58) Field of Classification Search
None
See application file for complete search history.

(56) References Cited

U.S. PATENT DOCUMENTS

2007/0040512 A1 2/2007 Jungwirth
2008/0049440 A1 2/2008 Gaydoul
(Continued)

FOREIGN PATENT DOCUMENTS

DE 102013112906 5/2015
EP 1969903 9/2008
(Continued)

OTHER PUBLICATIONS

English translation of Written Opinion dated Aug. 3, 2017 from corresponding International Application No. PCT/EP2017/060944, 5 pages.
(Continued)

*Primary Examiner* — Jany Richardson
(74) *Attorney, Agent, or Firm* — Ohlandt, Greeley, Ruggiero & Perle, L.L.P.

(57) ABSTRACT

A lighting device for interior spaces or rooms is provided. The lighting device has a plurality of lighting units that are individually calibrated. Further, the lighting device has a regulating device, which, based on corrected color and/or intensity values, forms a control value with which light sources of the lighting units are actuated in order to achieve a specified color and/or intensity value.

22 Claims, 6 Drawing Sheets

(51) Int. Cl.
*H05B 47/175* (2020.01)
*H05B 47/11* (2020.01)

(56) References Cited

U.S. PATENT DOCUMENTS

| | | | | |
|---|---|---|---|---|
| 2009/0289580 | A1 | 11/2009 | Dunn | |
| 2009/0302781 | A1* | 12/2009 | Peker | G09G 3/3413 315/297 |
| 2010/0315010 | A1* | 12/2010 | Damink | H05B 33/0857 315/152 |
| 2013/0270998 | A1* | 10/2013 | Pi | H05B 33/0863 315/51 |
| 2016/0270183 | A1 | 9/2016 | Wölfing | |

FOREIGN PATENT DOCUMENTS

| | | |
|---|---|---|
| EP | 2677387 | 12/2013 |
| JP | 2007184281 | 7/2007 |
| JP | 2013521171 | 6/2013 |
| WO | 2007091195 | 8/2007 |

OTHER PUBLICATIONS

English translation of International Preliminary Report on Patentability dated Nov. 11, 2018 from corresponding International Application No. PCT/EP2017/060944, 6 pages.
English translation of International Search Report dated Aug. 3, 2017 from corresponding International Application No. PCT/EP2017/060944.

* cited by examiner

LIGHTING DEVICE WITH CONSISTENT LIGHTING PROPERTIES

CROSS REFERENCE TO RELATED APPLICATIONS

This application is a continuation of International Application No. PCT/EP2017/060944 filed on May 8, 2017, which claims the benefit under 35 USC § 119 of German Patent Application No. 102016108754.8 filed May 11, 2016, the entire contents of all of which are incorporated herein by reference.

BACKGROUND

1. Field of the Invention

The invention relates to lighting systems in general. In particular, the invention relates to lighting with light sources that are coordinated with one another and to the lighting conditions.

2. Description of Related Art

In the case of lighting systems with several light sources, there may be the need for coordinating these light sources to one another in terms of color and brightness, and this is particularly desirable when the light emission is produced over an extended region, such as approximately along a line or a surface area. Varying brightness or different color hues are particularly conspicuous here. Moreover, additional light sources are often also present, the intensity of which fluctuates. This happens, for example, in a room with incidence of daylight. However, in such case, it may nevertheless be required to keep color coordinates and brightness constant.

A regulated color light source comprising a lighting unit that has at least two LEDs is known from the German Patent Application DE 10 2013 112 906 A1, wherein the color and/or brightness representation is regulated by way of a sensor. Several such light sources, each with identical emission optics, can be joined to make up a lighting unit. The emission optics comprise a light guide, in which the light is uncoupled by means of a scattering layer introduced laterally on the light guide, and said layer can be designed as a plastic or glass bar, for example.

Difficulties arise, of course, with respect to a color and/or brightness representation coordinated with one another, thus a consistent color and/or brightness representation, when, in the scope of a special lighting design, not only lighting devices of the same construction, but even of different construction are to be coordinated with one another. This is the case then when different emission optics are to be used, for example, emission optics that deliver their light in lines, over large surface areas, or are only punctiform or deliver light in a plurality of points (for example, as a so-called "starry sky"), or when different LED types or LED bins with deviating spectral properties are installed in the lighting devices, or when, for example, RGB and RGBW lamps are to be coordinated with one another.

SUMMARY

The object of the invention is to provide a lighting system that provides a consistent lighting with the use of different lighting units.

The following definitions apply in the scope of the present invention.

An emission optics is understood to be an optical component, by means of which light from a light source that typically has only a small diameter, i.e., for example, is viewed as almost punctiform, as is the case, for example, in light-emitting diodes, is taken up, forwarded, and distributed according to a specified distribution over a specified surface area and/or a specified spatial angle range. In the scope of the present invention, the term emission optics is thus used as a synonym for the term light distributor or diffusor.

A lighting unit is understood to be a device that delivers electromagnetic radiation in the wavelength region of 380 nm to 780 nm. In this case, a lighting unit comprises at least one light source, thus a unit by means of which light is generated.

A storage unit is understood to be a unit in which data are stored, for example, in the form of a matrix or a list.

A lighting is understood to be consistent, in which the color as well as the brightness representation of a plurality of lighting units are coordinated with one another, and preferably, the light emitted from the lighting units does not deviate or hardly deviates from the coordinated values within the scope of physiological perception.

According to the present invention, a lighting device for coordinated lighting, in particular of interior spaces or rooms, is provided, which comprises a plurality of spatially distributed lighting units, wherein the lighting units each have at least one light source, as well as at least one first sensor, and a calibrating device with a storage unit, in which calibration values are stored, and wherein the individual lighting units are individually calibrated, so that each calibrating device has individual calibration values, wherein, in particular, the calibration values represent value pairs of calibrated actual values and corresponding measurement values of the sensor of the light sources. The calibrating device is equipped to receive measurement values of the sensor, and, based on the sensor values, to form a corrected color and/or intensity value. In addition, the lighting device comprises at least one regulating device, which, based on the corrected color and/or intensity values, forms a control value with which the light sources are actuated in order to achieve a specified color and/or intensity value.

In this way, it is achieved in a simple way that a consistent color and/or brightness representation, thus color and/or brightness that are coordinated with one another, will be realized in an environment such as an interior space.

According to an alternative embodiment of the invention, a lighting device for coordinated illumination having a plurality of spatially distributed lighting units is provided, wherein each of the lighting units in turn has at least one light source, as well as at least one first sensor, and a calibrating device with a storage unit, in which calibration values are stored. The individual lighting units are also individually calibrated, so that each lighting unit consequently has individual calibration values, wherein, in particular, the calibration values represent value pairs of calibrated actual values and corresponding measurement values of the sensor of the light sources. In this embodiment, the lighting device comprises at least one regulating device that is equipped to receive measurement values of the sensor and forward them to the calibrating device, as well as to forward specified color and/or intensity values to the calibrating device, wherein, based on the measurement values of the sensor as well as from the specified color and/or intensity values from the regulating device, the calibrating device forms a control value, with which the light sources are actuated in order to achieve a specified color and/or intensity value of the lighting units. Unlike the embodiment that was explained above, the control value here is thus generated by the calibrating device, wherein the generation also comprises the changing of a control value based on the stored calibration values.

According to a particularly preferred embodiment of the invention, it is provided that each of the lighting units has at least two separately actuated light sources that emit light in spectral distributions that are different from each another. In this way, by separate actuation, not only the brightness, but also a desired color value can be accurately set.

Particularly preferred is a lighting device that comprises a setting unit. The latter is equipped to output desired values for brightness and/or intensity to the at least one regulating device, so that upon response of the regulating device to an obtained desired value, the brightness and/or color of the light sources of a plurality of lighting units will be changed. A higher-level setting of the light sources will be achieved with the setting unit. In addition, for a consistent illumination, it is particularly advantageous if the setting unit and the regulating device are equipped to change the brightness and/or color of the light sources of several lighting units, so that light intensity and/or color hue of the emitted light are equalized, or will be equalized. This equalization, in which conspicuous differences in brightness, e.g. between adjacent lighting units, are no longer present, is achieved in this case by interacting with the individual calibration of the individual lighting units. The desired values and sensor values under consideration can be corrected with the calibration values, so that brightness and color differences between the lighting units can be equilibrated.

If an equalization of a plurality of lighting units with respect to brightness and/or color takes place, it is generally favorable if, according to one embodiment of the invention, the corrected color and/or intensity values formed by the respective calibrating devices are substantially the same or will be equalized.

In particular, the lighting device can also be equipped so that, in the operating state, it emits homogeneous light with a light color and an intensity such that, for the human observer, the individual lighting units appear to emit substantially the same light color and intensity.

Such an arrangement of different lighting units in the lighting device according to the invention is advantageous, in particular, due to the circumstance that, in this way, for example, aging phenomena that are based on a change in the emission characteristic of a light source can be equilibrated. Also, the exchange or replacement of lighting units has become possible in a simple way, without resulting in a difference in the color and brightness representation of the entire lighting device.

If, for example, according to a preferred embodiment of the invention, the light sources are designed as semiconductor light-emitting elements (so-called light-emitting diodes or LEDs, or also laser diodes), the aging of such a semiconductor element in the lighting device can be compensated in a simple way. Also, lighting devices of different manufacturers or structural type can be used.

According to one embodiment of the invention, at least one emission optics of at least one lighting unit is configured as an optical fiber or comprises a light-guiding fiber or a light-guiding bar.

By way of example, the emission optics can be designed in a shape such that the light coupled in the emission optics is emitted laterally, thus is delivered in the form of a narrow, lengthwise-extended surface area or is "line-shaped". Of course, an emission of the light at an end face of a light guide is also possible, so that the light is delivered in the form of a point or circle, for example, with a diameter of a few millimeters. In the scope of the present invention, such an emission optics is also designated as "punctiform". It is also possible that the emission optics comprises a plurality of different light-guiding fibers, for example, a so-called fiber bundle.

In the case of the lighting device according to the invention, at least one first sensor is associated with each lighting unit. According to one embodiment of the invention, said sensor is arranged so that a part of the light that is emitted from the respective lighting unit is detected, and the sensor is connected in each case by way of an interface to the regulating device of the corresponding lighting unit or to the calibrating device.

According to another embodiment of the invention, the lighting device comprises a plurality of lighting units of the same kind, having light sources, sensor, storage unit, and regulating device, to which different emission optics are coupled, wherein the lighting device will be formed in each case with the lighting device units and the emission optics coupled to these.

Preferably, calibration values as well as specified desired values for the emission characteristic of the corresponding lighting unit are stored in the respective storage unit. wherein the calibration values and/or the specified desired values are formed differently between different lighting units.

According to another embodiment of the invention, in this case, the regulating device is configured each time such that it converts the measurement values of the respective sensor into actual values, and, based on a regulating algorithm composed of the particular current control value, the particular specified desired value involved, as well as the particular actual values, calculates a new control value.

In addition, the regulating device is connected in each case via an interface to a supply unit, by means of which the electrical power and/or the pulse width and/or the frequency of the electrical supply of the light sources in the particular lighting unit is regulated.

The sensor signal is thus matched with a desired value and is utilized for regulating the light sources, for example, by making it available to a regulating device.

According to one embodiment of the invention, the sensor of a lighting unit is arranged so that it receives light that is uncoupled in front of the emission optics.

Such an arrangement of the sensor is particularly suitable for the purpose of determining and correcting an aging of the light sources independently from the influence of the emission device.

According to yet another embodiment of the invention, the number of calibration values is so large and the spectral brightness distributions of the light sources are so different, that a color angle of at least 180° in the HSV color space can be represented with one lighting unit.

The so-called HSV color space involves a color representation, in which a color impression is defined by the data of three values, namely the color hue (H), which is defined in a color circle by specifying an angle; a saturation (S), which is defined by the distance from the central point of the color circle; as well as the value for the brightness (value, V), which is specified between 0% (no brightness) and 100% (full brightness). For example, the color space can be specified in the shape of a cylinder, one base surface of which corresponds to a V value of 0% (no brightness) and the second base surface of which corresponds to a value of 100% (full brightness) and reproduces the color circle with full brightness, wherein S values that are obtained at a short distance from the central point of the color circle correspond to a color hue with only slight saturation, for example, an almost pure white on the second base surface, and with greater distance, the color effect increases, i.e., the color has a greater color saturation. In this case, the S values are often also specified in % or on a scale of 0 (no saturation) to 1 (full saturation).

In another embodiment of the invention, the lighting device is designed so that at least one second sensor is associated with at least one lighting unit, wherein the first and the second sensors associated with the corresponding lighting device differ with respect to their spatial orientation referred to the respective lighting unit. In particular, the first sensor is arranged closer to the lighting unit than the second sensor.

In this way, it is possible to take into consideration both intrinsic as well as extrinsic effects in setting the color and/or brightness representation of the lighting device.

An intrinsic effect is to be understood here as one that refers to the individual lighting unit itself, for example, as a consequence of an aging of the lighting unit or is based on its different kind of structure, such as for example, with respect to the light sources that it comprises. In contrast to this, an extrinsic effect is one that is influenced by external phenomena. Such an effect can also be taken into consideration for more than one lighting unit, for example, and also for all lighting units. Frequently, such extrinsic effects are not local, i.e., they can be determined in a spatially greater region near the light sources that the lighting unit comprises, but only within a specific distance. By way of example, such extrinsic effects or factors may involve a brightness that fluctuates over the course of a day in the three-dimensional space furnished with a lighting device, but also may involve soiling or aging of one or more emission optics.

According to an enhancement of the invention, the second sensor also comprises a storage element, in which calibration values are stored, which link desired values of color and/or brightness with possible actual values. This storage element of the second sensor is connected to the corresponding lighting unit by way of an interface.

Preferably, the second sensor is associated with a group of lighting units in a form such that the second sensor is connected to a plurality of lighting units by way of the interface.

In this case, according to another embodiment of the invention, the second sensor is associated with all lighting units of the lighting device.

For special lighting designs, it may be necessary that a specific parameter, for example, the color representation of two different lighting units is always to be coordinated between the two units, whereas, with respect to another parameter, for example the brightness, specific lighting units are to be present uncoupled from other lighting units of the lighting device. By way of example, in one configuration of the lighting device, one portion of the lighting units can be equipped by means of a plurality of light-guiding fibers in the form of a so-called "starry sky", whereas a second portion of the lighting units provides emission optics with surface-area or linear light output. With such a configuration of the lighting device, it may be expedient that the lighting units are coordinated among themselves in a form relative to one another such that a uniform color impression or a uniform color temperature is always realized; of course, such lighting units that emit light, for example, linearly, are controlled differently from the remaining lighting units with respect to brightness, in a form such that when darkness is present, they are set brighter than the remaining lighting units. Thus, an arrangement may be useful, for example, for reasons of safety, if the linear emission optics mark safety paths.

According to yet another embodiment of the invention, the lighting device is therefore configured such that it comprises a plurality of second sensors, each of which is associated with a group of lighting units, preferably with a group of lighting units that comprise identical emission optics or the same kind of emission optics.

Such a coordinated interior space illumination, which is also particularly in a position to take into consideration extrinsic effects, for example, to compensate for them, is particularly relevant in this case for those interior spaces that are used for passenger and/or goods traffic. For example, a lighting unit such as described in the preceding is suitable for a vehicle or aircraft cabin.

Preferably such a vehicle or aircraft cabin is characterized by the fact that the lighting device comprises at least one linear orienting lighting and at least one reading lamp.

Another aspect of the present invention relates to a method for coordinated interior space lighting. In the case of the method according to the invention, the color and/or brightness values of the lighting of the interior space are determined with at least one second sensor of the above-described lighting device. The actual values obtained are compared with desired values of the lighting. Based on the sensor values, a deviation of a desired value for the brightness and/or color from an actual value is determined. In this case, the brightness and/or color of the lighting unit associated with this second sensor is or are set by way of the regulating device of the at least one second sensor, in order to equalize desired and actual values.

In one enhancement of the method, the desired values stored in the storage unit of the second sensor vary over time in a form such that an interior space lighting that is coordinated over the course of the day is made possible.

BRIEF DESCRIPTION OF THE DRAWINGS

The invention is explained in detail in the following on the basis of the drawings.

DETAILED DESCRIPTION

Figure 1:
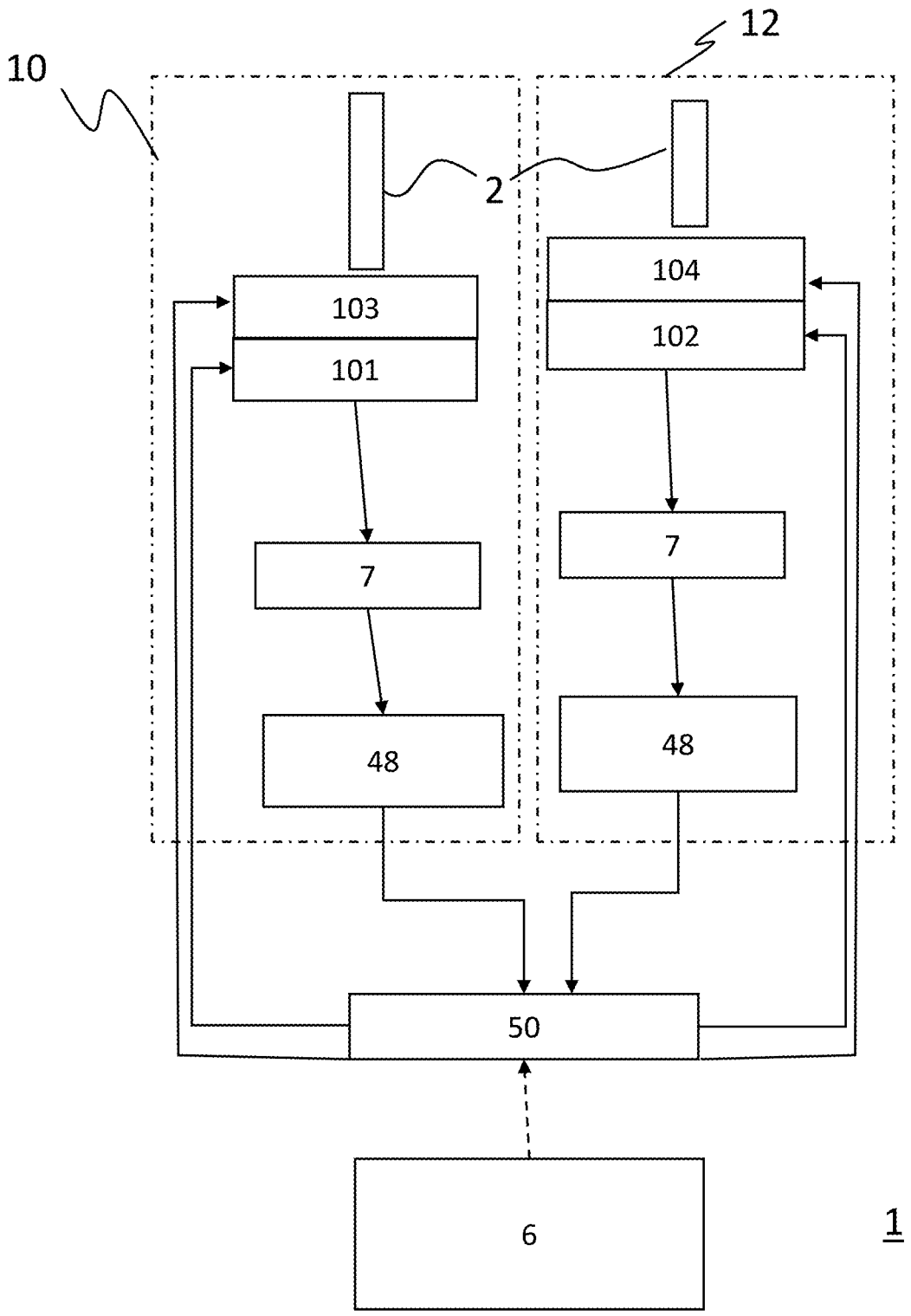
FIGS. 1 to 5 show different embodiments of lighting devices according to the invention.

FIG. 1 shows an embodiment of a lighting device 1 for coordinated illumination. Said lighting device comprises at least two lighting units 10 and 12, each of which comprises at least one light source 101, 102, as well as at least one sensor 7 and a calibrating device 48. In each case, the sensor 7 measures the radiation emitted from the at least one light source 101, 102 and forwards the obtained measurement values to the calibrating device 48. In this case, the lighting units are present as spatially distributed. For example, the lighting units 10, 12 can be present as distributed in an interior space, so that a coordinated illumination is possible by means of a lighting device 1 configured in such a manner. The light sources 101, 102 are preferably semiconductor light-emitting elements, such as light-emitting diodes, in particular.

The calibrating device 48 provides a storage unit, in which calibration values are stored. In this case, the individual lighting units 10, 12 are calibrated individually, so that each lighting unit 10, 12 in general already has individual calibration values based on the different characteristics of the light sources. In particular, the calibration values represent value pairs of calibrated actual values and corresponding measurement values of the sensor of the light sources.

The calibrating device 48 is equipped to receive measurement values of the sensor 7, and, based on the sensor values, to form a corrected color and/or intensity value. In addition, the lighting device 1 comprises a regulating device 50, which, based on the corrected color and/or intensity values, forms a control value with which the light sources are actuated in order to achieve a specified color and/or intensity value. Alternatively, static or dynamic specifications for the color coordinates and intensity can be stored in the lighting device and these are retrieved by the setting unit at a specific point in time.

By way of example, the lighting device 1 additionally comprises a setting unit 6 that determines the specifications of the lighting device 1 with respect to spectrum and intensity emitted by the lighting device.

Preferably, the light sources 101, 102 are designed as semiconductor light-emitting elements (so-called LEDs). By way of example, the light sources can be designed as blue LEDs that preferably emit light in the wavelength region from 430 nm to 780 nm, or as red LEDs that preferably emit light in a wavelength region from 600 nm to 660 nm, or as green LEDs that preferably emit light in the wavelength region from 500 nm to 560 nm. Also, by way of example, a light source can be designed as an LED emitting white light.

The invention is particularly suitable also for the use of lighting units 10, 12 that have at least two separately actuated light sources that emit light in spectral distributions that are different from each another. In the example shown in FIG. 1, each of the lighting units 10, 12 has two light sources 101, 103, or 102, 104, respectively, which differ in the spectrum of their emitted light. The light sources 101, 102, 103, 104 are all separately controlled by the regulating device 50. Accordingly, for the two lighting units 10, 12, not only can the brightness be changed, but, by setting different intensities of the light sources and thus intermixing the spectral distributions, the color hue can be changed. According to one embodiment of the invention, without limitation to the exemplary embodiment especially presented, at least one of the lighting units has three-color or four-color light-emitting diodes, i.e., three or four light-emitting diodes, in order to be able to represent different colors and brightness.

The lighting units 10, 12 can comprise emission optics 2, for example, as optical fibers, light-guiding fibers or a light-guiding bar. In this case, the emission optics 2 can also differ individually or in groups with respect to their shape and emission characteristic.

In order to bring about a uniform image with respect to color and light intensity for an observer, the corrected color and/or intensity values formed by the respective calibrating devices 48 can be substantially equal. Therefore, homogeneous light with a light color and an intensity is emitted from the lighting device 1 in the operating state, so that the individual lighting units 10, 12 emit the same light color and intensity for the human observer. Any remaining differences are thus not noticed or at most are barely perceived.

In other words, FIG. 1 also describes a lighting device 1, in particular for the coordinated illumination particularly of interior spaces, having at least two lighting units 10, 12, which are spatially separated from one another and each of which comprises at least one light source 101, 102, particularly with semiconductor light-emitting elements that have different characteristics, in particular, as well as at least one sensor 7, and a common calibrating device or calibrating device 48 associated with the lighting units 10, 12, wherein, in the operating state, the sensor 7 measures the radiation emitted in each case from the at least one light source 101, 102 and forwards the obtained measurement values to the calibrating device 48, and wherein the calibrating device 48 provides a storage unit, or at least a storage unit is associated with this calibrating device 48, in which calibration values are stored, and wherein the individual lighting units 10, 12 are individually calibrated, so that each lighting unit 10, 12 has individual calibration values, and wherein, in the operating state, the calibrating device 48 receives measurement values of the sensor 7, and, based on the sensor values, forms a corrected color and/or intensity value, and wherein, in addition, the lighting system comprises a regulating device 50, which, in the operating state and based on the corrected color and/or intensity values, forms a control value, with which the light sources 101, 102 are actuated in order to achieve a specified color and/or intensity value, or wherein, in the operating state, static or dynamic specifications for color coordinates and/or intensity are stored in the lighting units 10, 12, and these are retrieved by the setting unit at a specific point in time.

Figure 2:
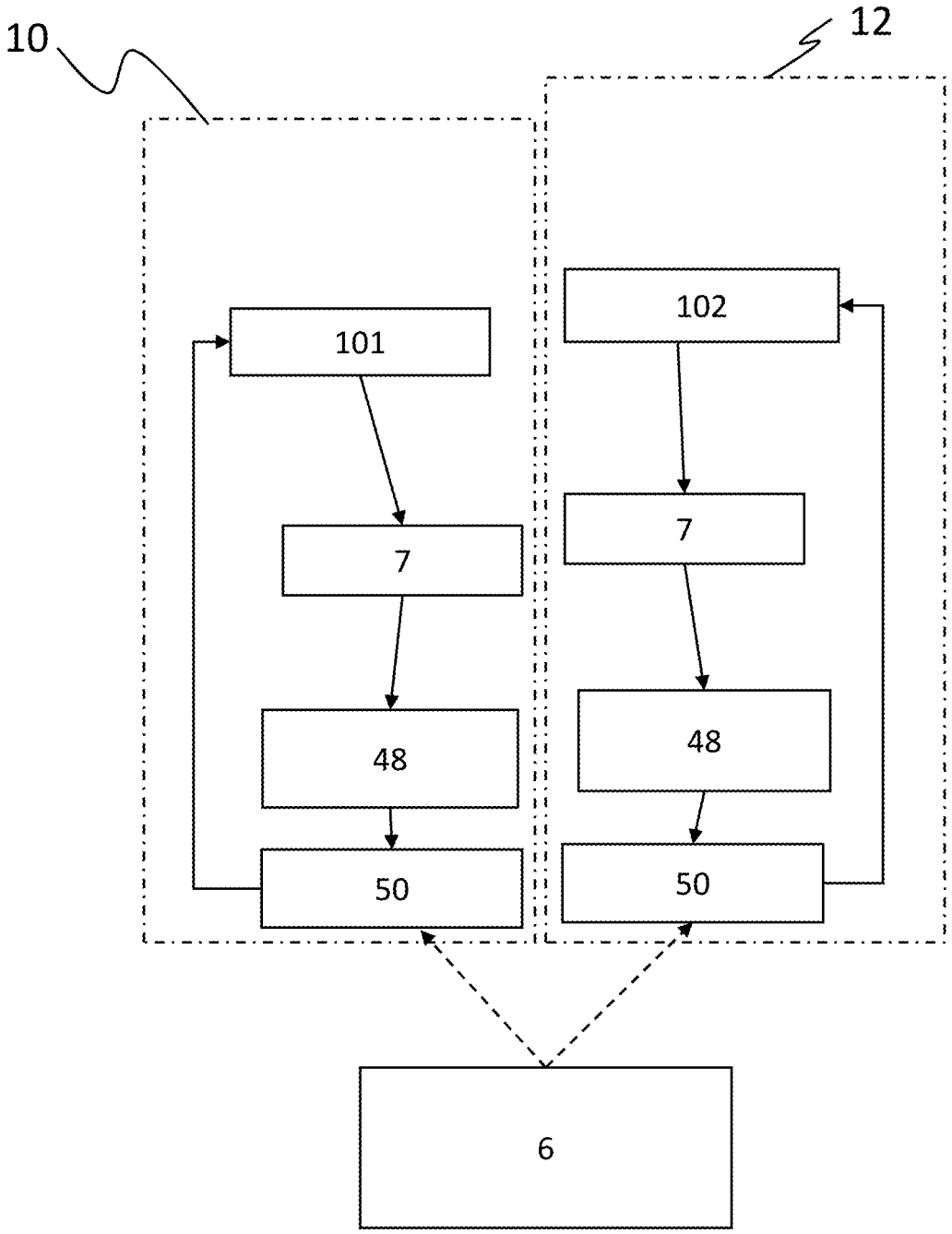

FIG. 2 shows another exemplary embodiment of a lighting device 1. Several separate regulating devices 50 are provided for this lighting device 1, wherein a regulating device 50 is associated with each lighting unit 10, 12, or is a component of the associated lighting unit 10, 12. Here also, the lighting units 10, 12 are individually calibrated, wherein the calibrating devices 48 are equipped to receive measurement values of the sensor 7 of the respective lighting units 10, 12, and to form a corrected color and/or intensity value based on the sensor values. Each of the regulating devices 50 forms control values for the associated lighting device 10, 12, by which the light sources are actuated in order to achieve a specified color and/or intensity value.

Figure 3:
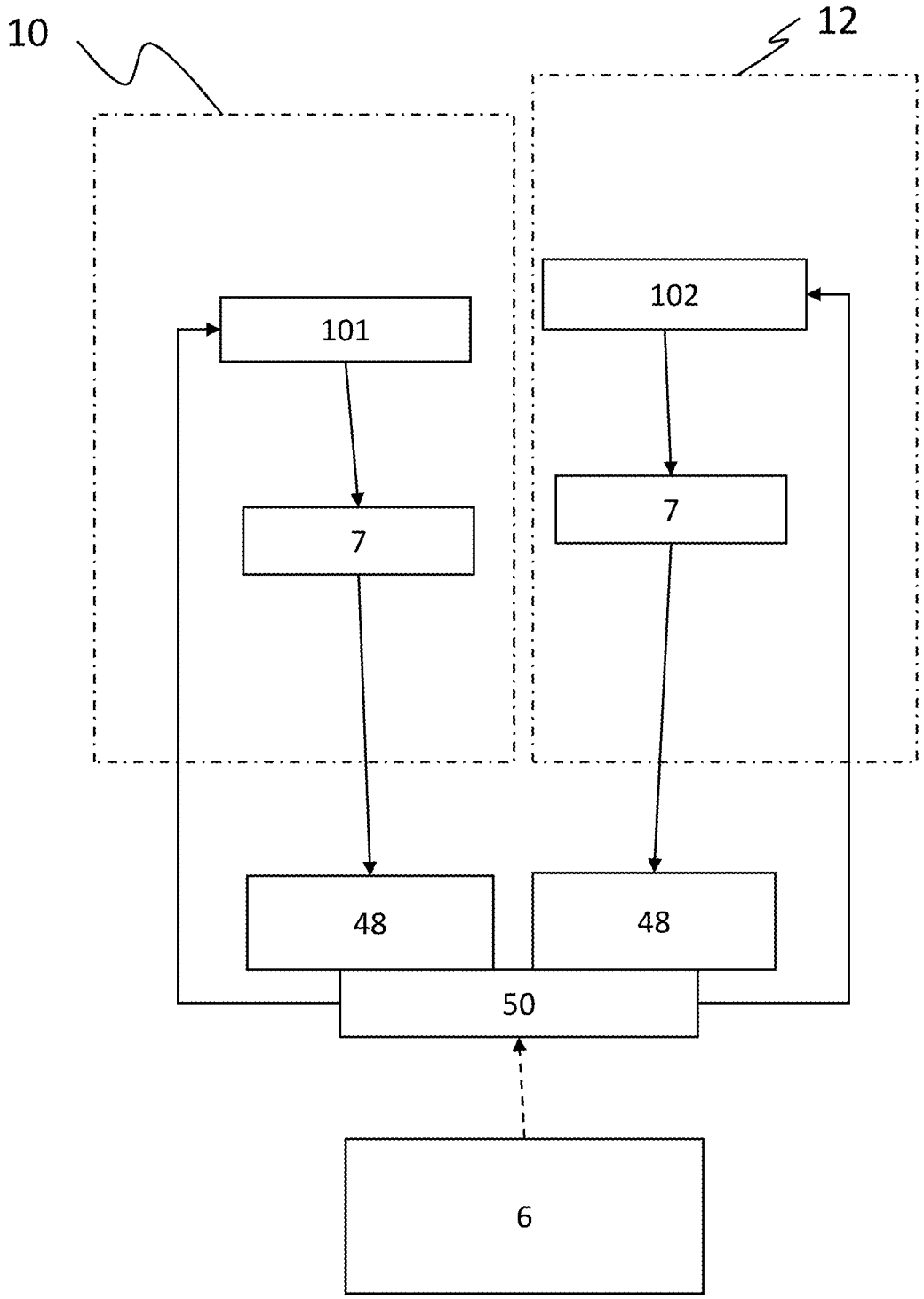

FIG. 3 shows a variant of the embodiment shown in FIG. 1. Also for the embodiment shown in FIG. 3, the calibrating devices 48 are connected to a higher-level regulating device 50, wherein here, the calibrating devices 48 are also separate from the lighting units. In contrast, in the example shown in FIG. 1, the calibrating devices 48 are a component of the respective lighting units 10, 12.

Figure 4:
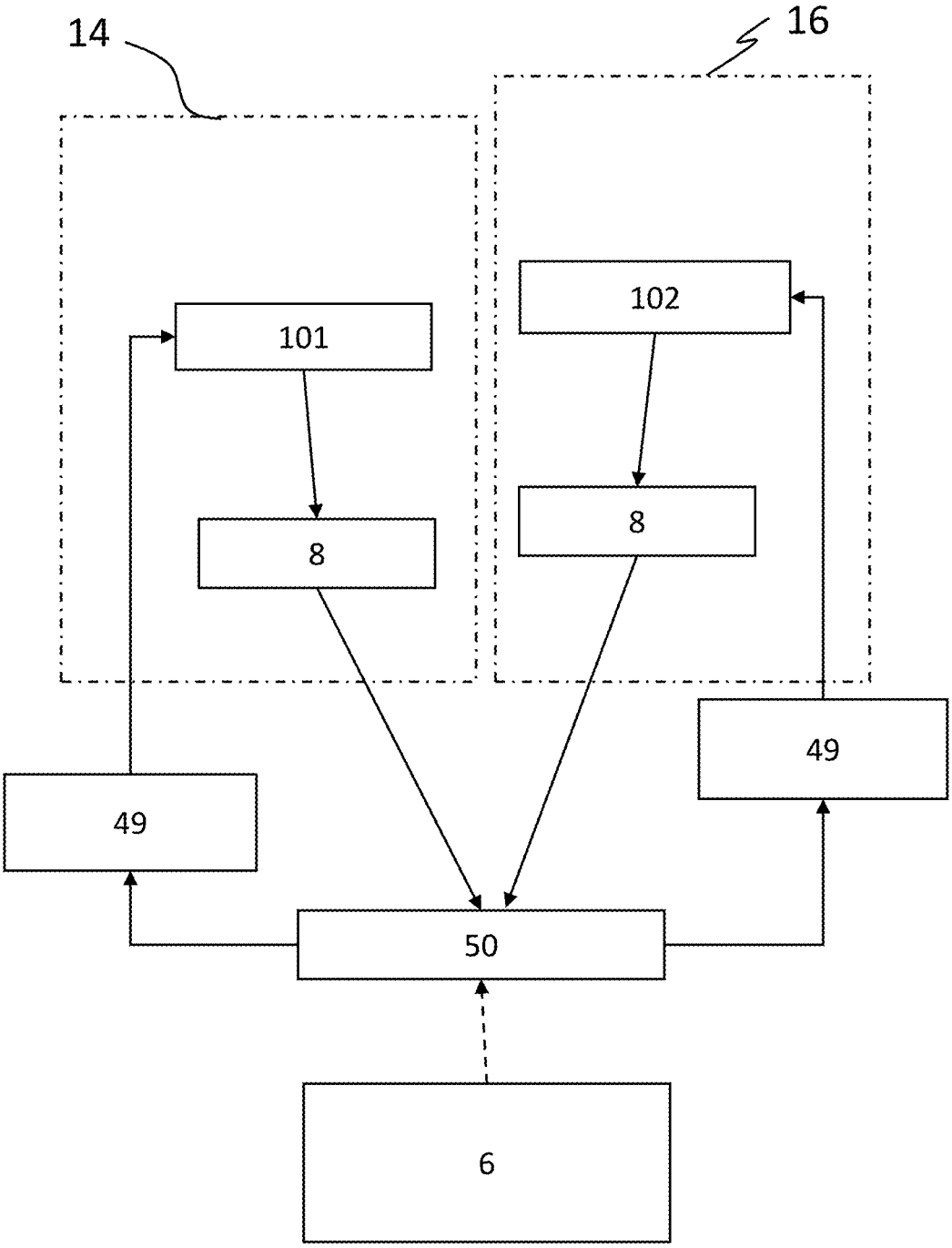
Figure 5:
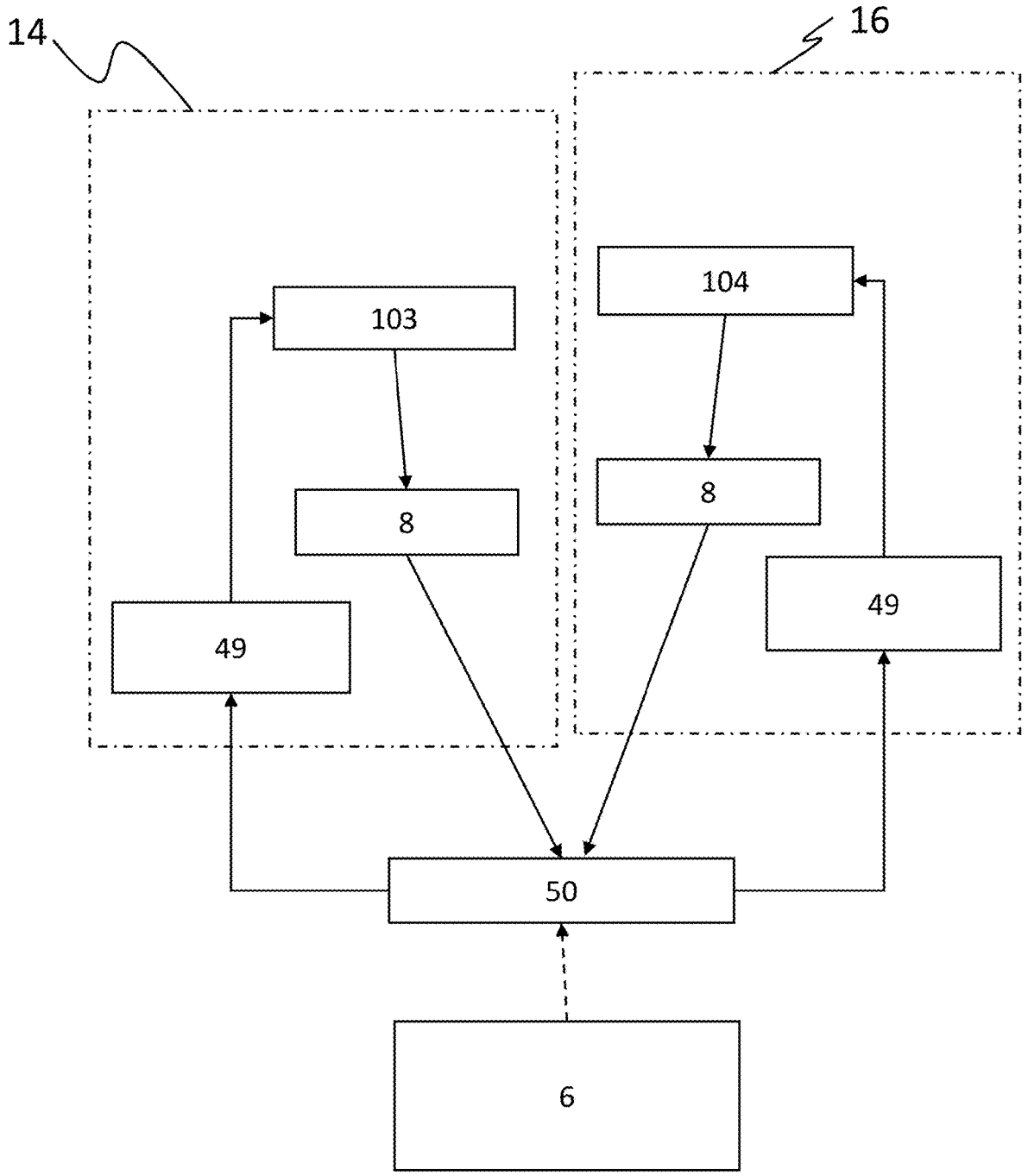

The embodiments of FIG. 4 and FIG. 5 differ from the embodiments described previously effectively in that here, the control values are corrected with a calibrating device 49 based on the calibration values stored in it. In contrast, the calibrating device is interposed between the regulating device 50 and the light sources 101, 102. In the embodiments of FIG. 1 to FIG. 3, in contrast, the calibrating device is connected downstream of the sensor 7 or interposed between the sensor 7 and the regulating device 50, respectively. For the embodiment shown in FIG. 4, the calibrating devices 49 are arranged outside the lighting units 14, 16, while in the embodiment of FIG. 5, they are a component of the lighting units 14, 16.

In each case, these embodiments are based on the fact that the lighting device comprises at least one regulating device 50, which is equipped to receive measurement values of the sensor 7, and to forward them to the calibrating device 49, as well as to forward specified color and/or intensity values to the calibrating device 49, wherein, based on the measurement values of the sensor as well as from the specified color and/or intensity values from the regulating device 50, the calibrating device 49 forms a control value, by which the light sources are actuated in order to achieve a specified color and/or intensity value.

In all embodiments of FIG. 1 to FIG. 5, a setting unit 6 is provided, which is equipped to output desired values for the brightness and/or intensity to the at least one regulating device 50, so that upon response of the regulating device 50 to an obtained desired value, the brightness and/or color of the light sources is or are changed in each of several connected lighting units 10, 12, 14, 16. The setting unit 6 can generally be set up as a user interface. For example, a specific, desired lighting scenario, controlled technically by a program, can be set with the use of the multiple number of connected lighting units. Thus, for example, a program could run, which simulates the light of the rising sun, and changes in brightness and color hue.

Figure 6:
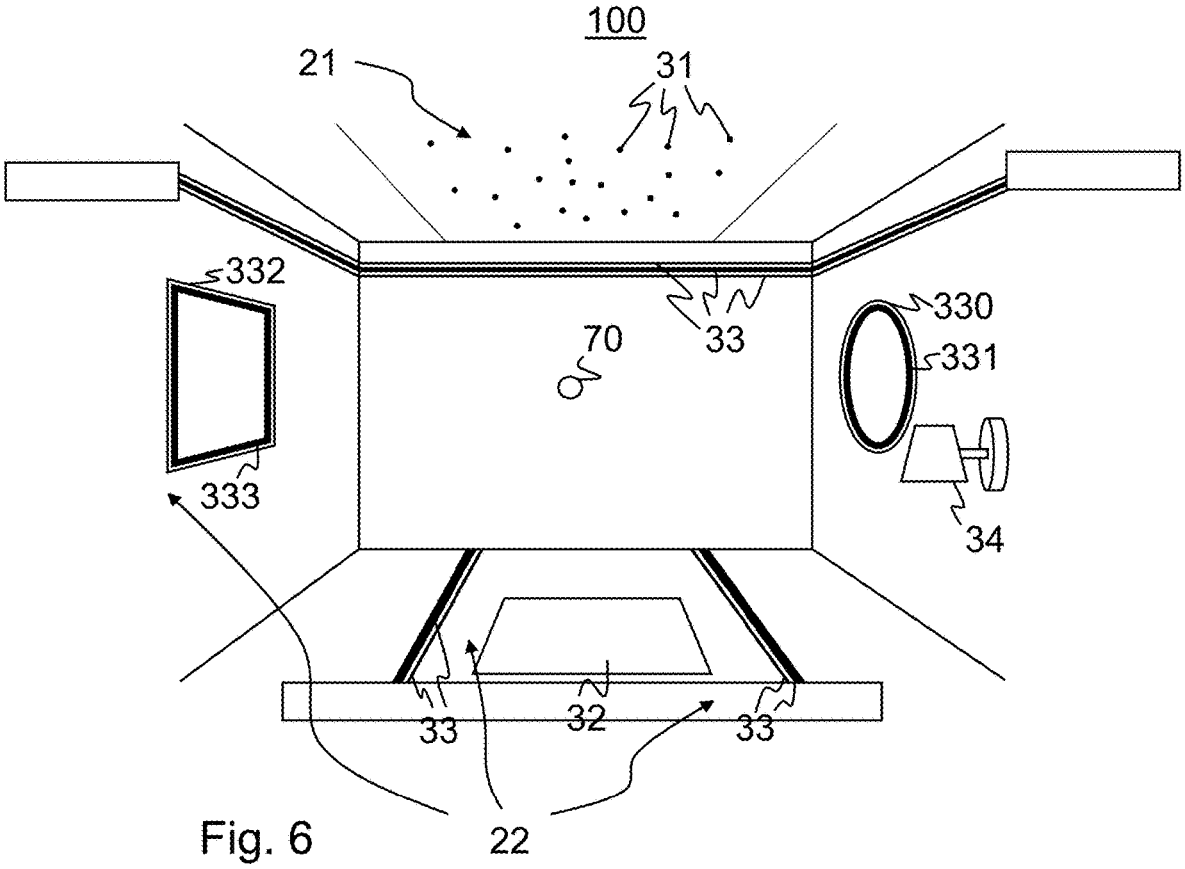
FIGS. 6 and 7 show interior spaces with a lighting device according to the invention.

Shown in FIG. 6 is an interior room 100 that is furnished with a lighting device according to the present invention. In this case, the lighting device is installed so that only the different emission optics are visible in the interior room 100. By way of example, the light distribution on the ceiling is produced in the form of points of light 31 (because of the overview, not all of these are denoted), and each point has only a small diameter of at most one centimeter, but preferably less, so that the impression of a starry sky is produced. On the floor, the light distribution is produced over a surface area in a central region, shown here, for example, in the form of a rectangular lighting tile 32. Such a lighting tile, for example, can be useful for the formation of so-called "floor lights". In the floor region on the side of the interior room shown here, the light distribution is produced in the form of lines 33. By way of example, risers or platforms on the floor can be characterized by such lines 33. In this way, it is also possible to produce an orienting lighting in order to characterize escape routes. In addition, by means of circular-shaped (330) or rectangular (332) lines, it is possible to characterize particular places in the interior room, for example, in the form of a contour lighting of windows (331) or frames (333), such as is shown also, for example, in FIG. 6. In addition, another linear light distribution 33 is illustrated in the upper region of the wall. Finally, a light distribution in the form of a reading lamp 34 is also possible, which is shown here schematically in the wall region at the right.

In addition, according to the invention, it is possible to coordinate this lighting device by means of a sensor 70 to another and to extrinsic effects, for example, to daylight passing through the window 331. By way of example, the sensor is arranged here in the end surface of the interior room furnished with the lighting device according to the present invention. It is also possible, of course, to install this sensor 70 at another particularly sensitive place with respect to the lighting of the interior room. It may also be useful to combine various lighting units into groups and to coordinate with different sensors. For example, it may be useful to arrange a sensor for extrinsic effects in the floor region of an interior space 100, this space being designed, for example, in the form of a vehicle or aircraft cabin, since, according to experience, this region is influenced far less intensely by light passing through the window of the cabin. In this way, it can be ensured that the orienting lighting for marking an escape route is always well visible, as a function of the total brightness of the aircraft cabin, but without introducing a detrimental effect for passengers due to disruptive light effects (so-called light pollution) during night-time rest during flight.

In order to obtain a consistent lighting, e.g., of an interior space 100, for example, in the form of the above-described aircraft cabin, in general and without limitation to special embodiments of the invention, it may be very advantageous to operate the different lighting units in groups. In general, it is provided for this purpose, in an enhancement of the invention, that the lighting device 1 comprises at least a first group of lighting units and thus a first number of calibrating devices 48, 49 in the first group, and a second number of calibrating devices 48, 49 in the second group, wherein the corrected color and/or intensity values formed by the respective calibrating devices of the first group are substantially equal within the first group, and the corrected color and/or intensity values formed by the respective calibrating devices of the second group are substantially equal within the second group, so that, in the operating state, the first group of lighting units emits light in a first spectral range and/or a first intensity, and the second group of lighting units emits light in a second spectral range and/or emits a second intensity.

Such groups may be useful in order to be able to illuminate, e.g., the ceiling with a color or brightness different from other illumination, e.g. orienting lighting. Within the respective groups, however, on the other hand, the individual lighting units shall be coordinated with one another as much as possible in terms of color and brightness, so that no differences in brightness and color are perceptible. For this purpose, it is provided in an enhancement that, in the operating state, in the first group of lighting units, the lighting device 1 emits light with a first light color and a first intensity, and in the second group of lighting units, it emits light with a second light color and a second intensity, in such a way that, for the human observer, the individual lighting units of the first group appear to emit substantially the identical light color and intensity, and the individual lighting units of the second group appear to emit substantially the identical light color and intensity, wherein the light colors and/or intensities of the lighting units of the first group differ from those of the lighting units of the second group.

In the example shown in FIG. 6, e.g., the punctiform light distribution 31 on the ceiling can be produced by a plurality of lighting units, which are operated together as a first group 21. As the second group 22, for example, the lighting units for the linear distributions 33, 330, 332 can be combined, so that they illuminate in a uniform color hue with identical brightness. This group can then differ, if need be, from the color hue of the punctiform light distributions, whereby the different values are set by group.

Figure 7:
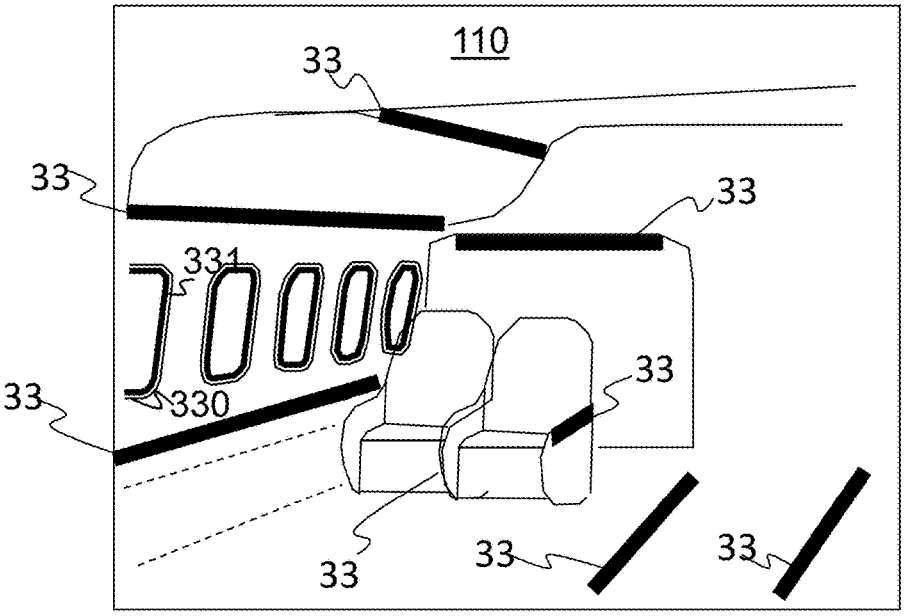

By way of example, FIG. 7 shows a representation of another interior space 100 with a lighting device 1 that comprises, for example, different linear light distributions 33, which are designed, for example, in the form of orienting lighting or as particular emphasis of structural elements. A light distribution that is designed in the form of a line or also in the form of a narrow, elongated surface area is denoted as linear here. A surface area is understood to be narrow here, if, in the surface area of the light distribution, the lateral extent in one direction is smaller at least by an order of magnitude than in the direction found in the plane perpendicular to the first direction. The windows 331 are also set off, for example, with linear light distributions 330. For a better overview, only one window 331 and one light distribution 330 are denoted. The interior space 100 is designed here in the form of a vehicle or aircraft cabin 110.

The lighting device for coordinated illumination in this case can be a subsystem of the overall lighting device for the space to be illuminated. This is particularly the case if deviations of color and/or intensity for specific light sources have no effect or only a small effect on the perceived balance of the lighting of the space. This is the case, for example, in light sources that should in fact have the same color, but are spatially far apart from one another, so that they are not consciously perceived at the same time. Another example can be a punctiform "starry sky lighting", since color deviations also occur between natural stars, and thus are not negatively evaluated in an artificial system. In this or similar cases, the cost advantage of an unregulated system will overcompensate for the only small disadvantage of said deviations.

LIST OF REFERENCE NUMBERS

| | |
|---|---|
| 1 | Lighting device |
| 10, 12, 14, 16 | Lighting unit |
| 100 | Interior space or interior room |
| 110 | Interior space in the form of a vehicle or aircraft cabin |
| 101, 102, 103, 104 | Semiconductor light-emitting element |
| 2 | Emission optics |
| 21, 22 | Group of lighting devices [sic; lighting units?]-Translator's note |
| 31 | Punctiform light distribution |
| 32 | Surface area light distribution, lighting tile |
| 33, 330, 332 | Linear light distribution, for example, orienting lighting |
| 331 | Window |
| 333 | Frame |
| 34 | Reading lamp |
| 41 | Data connection |
| 48, 49 | Calibrating device |
| 50 | Regulating device |
| 6 | Setting unit |
| 7, 8 | First sensor |
| 70 | Second sensor |

What is claimed is:

1. A lighting device for coordinated lighting, comprising:

a plurality of spatially distributed lighting units, wherein each lighting unit has a light source, a first sensor, and a calibrating device, the calibration device having a storage unit, each of the lighting units being individually calibrated so that the calibrating device of the particular lighting unit has individual calibration values stored in the storage unit, wherein the individual calibration values represent value pairs of calibrated actual values and corresponding measurement values of the first sensor, wherein the calibrating device is equipped to receive measurement values of the first sensor, and, based on the measurement values, to form a corrected color and/or intensity value; and a regulating device, which, based on the corrected color and/or intensity value, forms a control value with which the light sources of the lighting units are actuated in order to achieve a specified color and/or intensity value.

2. The lighting device of claim 1, wherein the corrected color and/or intensity values are substantially identical.

3. The lighting device of claim 2, wherein the corrected color and/or intensity values are configured to deliver light with a color and an intensity such that, for a human observer, the lighting units appear to emit substantially the same light color and intensity.

4. A lighting device for coordinated lighting, comprising:

a plurality of spatially distributed lighting units, wherein each lighting unit has a light source, a first sensor, and a calibrating device, the calibration device having a storage unit, each of the lighting units being individually calibrated so that the calibrating device of the particular lighting unit has individual calibration values stored in the storage unit, wherein the individual calibration values represent value pairs of calibrated actual values and corresponding measurement values of the first sensor; and a regulating device that receives the corresponding measurement values from the first sensor of each of the lighting units, forwards the corresponding measurement values to the calibrating device of each of the lighting units, and forwards specified color and/or intensity values to the calibrating device of each of the lighting units, wherein the calibrating device of each of the lighting units, based on the corresponding measurement values and the specified color and/or intensity values, forms a control value, by which the light source of the respective lighting unit is actuated in order to achieve the specified color and/or intensity value.

5. The lighting device of claim 4, the lighting source of least one of the plurality units comprises two separately controlled light sources that emit light in spectral distributions that are different from each another.

6. The lighting device of claim 4, further comprising a setting unit that outputs desired values for the brightness and/or intensity to the regulating device so that upon response of the regulating device to an obtained desired value, the brightness and/or color of the light sources of several lighting units is or are changed.

7. The lighting device of claim 6, wherein the setting unit and the regulating device are change the brightness and/or color of the light sources of the lighting units so that light intensity and/or color hue of the emitted light is or are equalized.

8. The lighting device of claim 4, wherein the light source is a semiconductor light-emitting element.

9. The lighting device of claim 4, wherein at least one of the lighting units comprises emission optics formed as an optical fiber or a light-guiding fiber or a light-guiding bar.

10. The lighting device of claim 4, wherein the lighting units each have different emission optics.

11. The lighting device of claim 4, wherein at least one of the lighting units provides a color angle of at least 180° in the HSV color coordinates.

12. The lighting device of claim 4, further comprising a second sensor associated with at least one lighting unit, wherein the first and second sensors differ with respect to spatial orientation with respect to the at least one lighting unit.

13. The lighting device of claim 12, wherein the second sensor comprises a control device having a storage element, in which calibration values are stored.

14. A lighting device for the coordinated lighting, comprising:

a regulating device;

a first lighting unit including a first semiconductor light-emitting element and a first sensor, the first semiconductor light-emitting element having a first light characteristic, the first lighting unit being individually calibrated with first calibration values;

a second lighting unit including a second semiconductor light-emitting element and a second sensor, the second lighting unit being individually calibrated with second calibration values, the second semiconductor light-emitting element having a second light characteristic that is different from the first light characteristic of the first semiconductor light-emitting element, the second lighting unit being spatially separated from the first lighting unit; and a calibrating device including a storage unit having the first and second calibration values stored therein, wherein, in an operating state, the first sensor measures radiation emitted by the first semiconductor light-emitting element, the second sensor measures radiation emitted by the second semiconductor light-emitting element, and the radiation measured by the first and second sensors is forwarded to the calibrating device, wherein the calibrating device, in the operating state, forms a corrected color and/or intensity values based on the radiation measured by the first and second sensors, and wherein the regulating device, in the operating state, forms a control value based on the corrected color and/or intensity values and actuates the first and second semiconductor light-emitting elements with the control value to achieve a specified color and/or intensity value.

15. The lighting device of claim 14, wherein the first and second calibration values represent value pairs of calibrated actual values and corresponding measurement values of the first and second sensors.

16. The lighting device of claim 14, wherein the regulating device actuates the first and second semiconductor light-emitting elements separately.

17. The lighting device of claim 14, wherein the regulating devices comprises a first regulating device associated with the first lighting unit and a second regulating device associated with the second lighting unit.

18. The lighting device of claim 14, wherein the calibrating device comprises a first calibrating device associated with but separated from the first lighting unit and a second calibrating device associated with but separated from the second lighting unit, the first and second calibrating device being connected with the regulating device.

19. The lighting device of claim 14, wherein the calibrating device is connected between the regulating device and the first and second semiconductor light-emitting elements.

20. The lighting device of claim 14, further comprising a setting unit equipped to output desired values for the brightness and/or intensity to the regulating device, wherein the regulating device is a user interface.

21. A vehicle or aircraft cabin comprising the lighting device of claim 14.

22. The vehicle or aircraft cabin of claim 21, wherein the first lighting unit is a linear orienting lighting and the second lighting unit is a reading lamp.

* * * * *